US005581960A

United States Patent [19]

Lewis

[11] Patent Number: 5,581,960

[45] Date of Patent: Dec. 10, 1996

[54] COMPOSITE BUILDING STRUCTURE

[76] Inventor: Andrew K. Lewis, R.R. 1, Box 517, Walpole, N.H. 03608

[21] Appl. No.: 130,018

[22] Filed: Sep. 30, 1993

[51] Int. Cl.[6] ..... E04H 1/00

[52] U.S. Cl. ..... 52/80.1; 52/81.4; 52/81.5; 52/73; 52/79.4; D25/4

[58] Field of Search ..... 52/80.1, 81.4, 52/81.5, 73, 79.4, 80.2, 608; D25/4, 32

[56] References Cited

U.S. PATENT DOCUMENTS

| | | | |
|---|---|---|---|
| D. 230,724 | 3/1974 | Infante | 52/79.4 X |
| 318,324 | 5/1885 | Terrell et al. . | |
| 3,118,010 | 1/1964 | Harrington . | |
| 3,225,413 | 12/1965 | Bird . | |
| 3,226,892 | 1/1966 | Rose et al. . | |
| 3,277,219 | 10/1966 | Turner . | |
| 3,299,585 | 1/1967 | Wilkins . | |
| 3,462,521 | 8/1969 | Bini . | |
| 3,533,202 | 10/1970 | Gellert | 52/80.1 |
| 3,646,718 | 3/1972 | McKenna . | |
| 3,691,003 | 9/1972 | Elischer . | |
| 3,696,566 | 10/1972 | Langner . | |
| 3,724,141 | 4/1973 | Kelleher . | |
| 3,750,353 | 8/1973 | Smith, Jr. | 52/80.1 |
| 3,751,862 | 8/1973 | Linecker | 52/80.1 |
| 3,802,133 | 4/1974 | Gregory | 52/80.1 |
| 3,807,105 | 4/1974 | Rudkin, Jr. et al. . | |
| 3,820,292 | 6/1974 | Fitzpatrick . | |
| 3,925,938 | 12/1975 | Molen . | |
| 3,940,105 | 2/1976 | Metrailer . | |
| 3,984,950 | 10/1976 | Hildebrand et al. . | |
| 3,984,957 | 10/1976 | Piazza . | |
| 4,026,077 | 5/1977 | Pickett . | |
| 4,077,177 | 3/1978 | Boothroyd et al. . | |
| 4,306,391 | 12/1981 | Crosby | 52/80.1 |
| 4,376,353 | 3/1983 | Helfman . | |
| 4,519,176 | 5/1985 | Britz . | |
| 4,545,159 | 10/1985 | Rizk . | |
| 4,578,915 | 4/1986 | Schneller . | |
| 4,633,629 | 1/1987 | Britz . | |
| 4,712,344 | 12/1987 | Erdei . | |
| 4,774,794 | 10/1988 | Grieb . | |
| 4,818,573 | 4/1989 | Nishiwaki . | |
| 4,836,714 | 6/1989 | Matiere . | |
| 4,886,084 | 12/1989 | Lawrence et al. | 52/80.1 |
| 4,944,127 | 7/1990 | Clear . | |
| 5,146,726 | 9/1992 | Ellison, Jr. . | |

FOREIGN PATENT DOCUMENTS

| | | | |
|---|---|---|---|
| 966187 | 10/1982 | U.S.S.R. | 52/80.1 |
| 1004562 | 3/1983 | U.S.S.R. | 52/80.1 |

OTHER PUBLICATIONS

The Patent Book by James Gregory, p. 27, (1979).
House and Home Publication, dated Sep. 1956, p. 133, top of page, roof structure illustration.
Copy of photograph of the completed structure.
Test of structure in which an automobile was placed upon the completed structure.
"Skyhouse"–A Brief.
"Skyhouse"–The Numbers.

*Primary Examiner*—Wynn E. Wood
*Attorney, Agent, or Firm*—David S. Resnick; Dike, Bronstein, Roberts & Cushman

[57] ABSTRACT

The present invention is directed to building modules, each having a portion of an ellipse as seen in cross-section, which can be interconnected to form a modular building structure having substantially unrestricted interior space, comprising at least two each having a portion of an ellipse as seen in cross-section without the use of interior supports. The shape of each building module of the present invention is selected such that when two are connected, the resulting building structure defines three spaces each having a portion of an ellipse as seen in cross-section. When four are connected, the resulting building structure defines six each having a portion of an ellipse as seen in cross-section. Similarly, additional building modules can be added, providing a system for preparing a building structure with a multitude of spaces each having a portion of an ellipse as seen in cross-section. If desired, half-unit building modules can be incorporated into the structure to extend the possible shapes of the resulting building. Thus, the module building system of the present invention comprises half-modules, full-modules and combinations thereof.

4 Claims, 2 Drawing Sheets

COMPOSITE BUILDING STRUCTURE

FIELD OF THE INVENTION

The present invention relates generally to building structures, and more particularly, is directed toward a composite building system and structures constructed from such a system.

BACKGROUND OF THE INVENTION

A construction technique of increasing importance is the use of modular components. Among their advantages are generally lower production and handling costs. Among these modular components, the most familiar is the composite flat panel. But in recent time, manufacturers have produced and marketed several type of curved-shape components. Typical of structures assembled from such modules are hemisphere domes, half-cylinder buildings such as so-called quonset huts, and hyperbolic paraboloid roof systems.

Each of these basic building shapes offers specific advantages and limitations. Hemispheres and half-cylinders offer the advantage of self-support; interior space can be unobstructed. But neither shape can be easily extended or varied by the simple addition of a module. A half-cylinder can only be extended in length. A hemisphere cannot be extended or varied at all by simple addition of a module. A hyperbolic paraboloid roof, on the other hand, can be extended without violation of module, but does not self-support; interior space is ordinarily obstructed by columns.

On a few occasions, single large hyperbolic paraboloids have been constructed in a self-support fashion with two opposite corners in ground contact. But the compound curve of a hyperbolic paraboloid in such applications is difficult to construct. More importantly, a hyperbolic paraboloid of practical size wastes space at the ground corners and, because of its saddle shape, deprives headroom at the center. The only way to enlarge these spaces is to enlarge the structure itself and, as a result, to increase its difficulty of construction.

As indicated, these above-discussed building configurations, modular or not, serve some purposes at the cost of others. They provide architects and builders with only limited means for architectural variation.

Accordingly, there exists a need for a modular building system which is economical, which is easy to construct, which can be varied or extended in any direction by the simple addition of basic modules, which, in any configuration, offers unobstructed interior space and consequently unlimited opportunity for interior design. The present invention provides just such a modular building system.

SUMMARY OF THE INVENTION

It is an object of the present invention to provide a composite building system and structure which does not suffer from the limitations present in the prior art building systems discussed above.

It is another object of the present invention to provide monolithic building modules, each having a portion of an ellipse as seen in cross-section, which can be interconnected to form a modular building structure having unrestricted interior space, comprising at least two bays, each having a portion of an ellipse as seen in cross-section without the use of interior supports.

The shape of each building module of the present invention is selected such that when two are connected, the resulting building structure defines three spaces each having a portion of an ellipse as seen in cross-section. When four are connected, the resulting building structure defines six spaces each having a portion of an ellipse as seen in cross-section. Similarly, additional building modules can be added, providing a system for preparing a building structure with a multitude of spaces. The interconnectibility of the modules is unlimited and requires no modification of the basic module shape. If desired, half-unit building modules can be incorporated into the structure to extend the possible shapes of the resulting building. Thus, the module building system of the present invention comprises half-modules, full-modules and combinations thereof.

The modules and half modules (or modular units) of the present invention may be formed from many materials commonly used in the construction industry. For instance, the modular units of this invention may be formed from a rigid foam core having a layer of reinforcing cementitious material adhered to each of its surfaces. Such a foam core may comprise a polymeric material such as polyurethane or styrene. Reinforcement of the cementitious material encasing such a foam core is typically provided by a substantially continuously extending metallic reinforcing substrate.

BRIEF DESCRIPTION OF THE DRAWINGS

A fuller understanding of the nature and objects of the present invention will become more apparent upon consideration of the following detailed description taken in connection with the accompanying drawings, wherein.

DETAILED DESCRIPTION OF THE PREFERRED EMBODIMENTS

Figure 1:
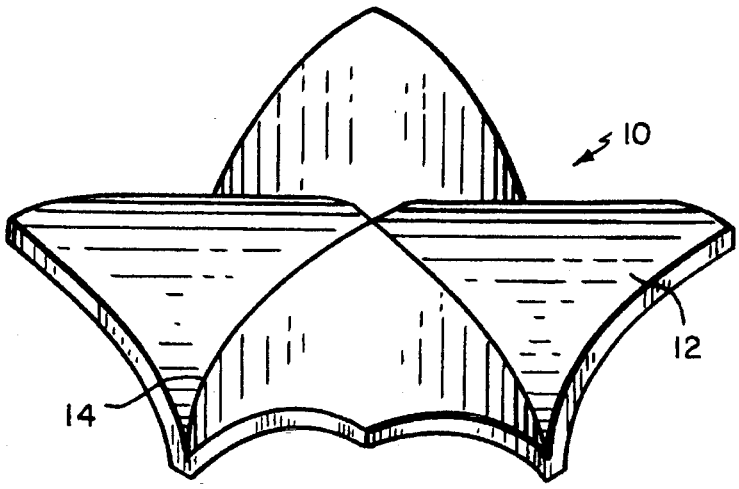
FIG. 1 is an end view of four modules (or eight half modules) joined to form a building structure in accordance with the present invention.

Referring to the Figures, wherein like reference numerals refer to like parts, there is illustrated a building structure 10. In the illustrated embodiment, building structure 10 is constructed using at least two interconnected modules 12.

Figure 2:
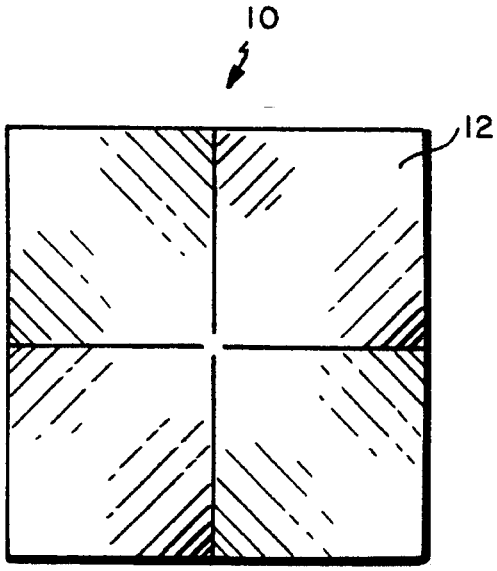
FIGS. 2 and 5 are top and bottom plan views of the building structure of FIG. 1, respectively.
Figure 5:
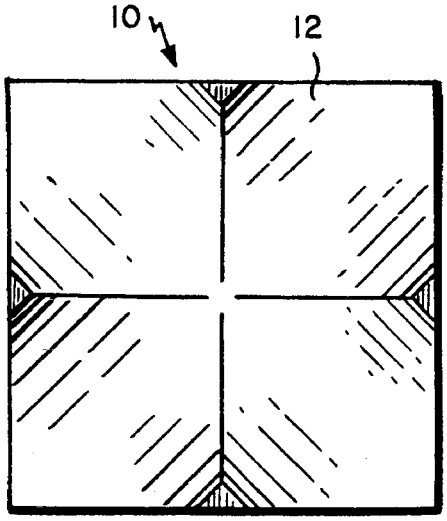

In elevation, each module structure 12 comprises a simple curve (not a 'double' or 'compound' curve) having a portion of an ellipse as seen in cross-section. In plan view (see FIGS. 2 and 5), each module 12 is square, wherein two opposite corners of the square are elevated and the other two opposite corners are in ground contact, acting as supports. Accordingly, if there is a change in elevation the length or curvature of the sides of the module are modified in order to maintain the squareness in plan.

As illustrated, any single module 12 can be joined at any one of its sides to any other like module. Thus, the building modules of the present invention represent the only singly-curved structures to which an identical structure can be joined at any of its four sides and at a right angle to create a building. The joint 14 between the modules 12 is preferably gasketed and caulked using methods familiar to those skilled in the building arts.

As aforesaid, while individual half-modules are not self supporting, two or more of such half-modules may be joined with full modules to extend the possible shapes of the resulting building.

Figure 3:
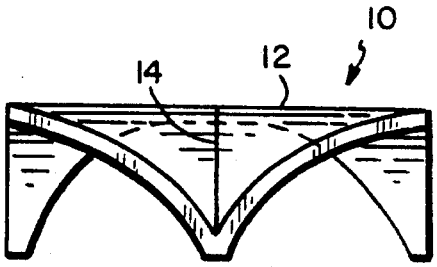
FIG. 3 is a side view showing the juncture of at least two modules.
Figure 4:
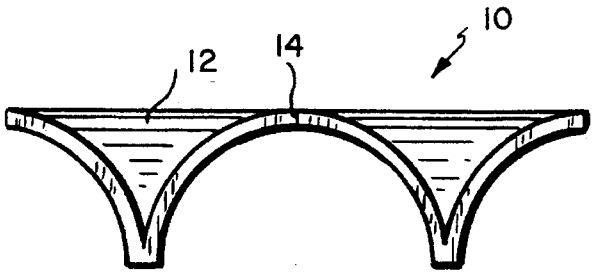
FIG. 4 is an end view of at least three modules.
Figure 6:
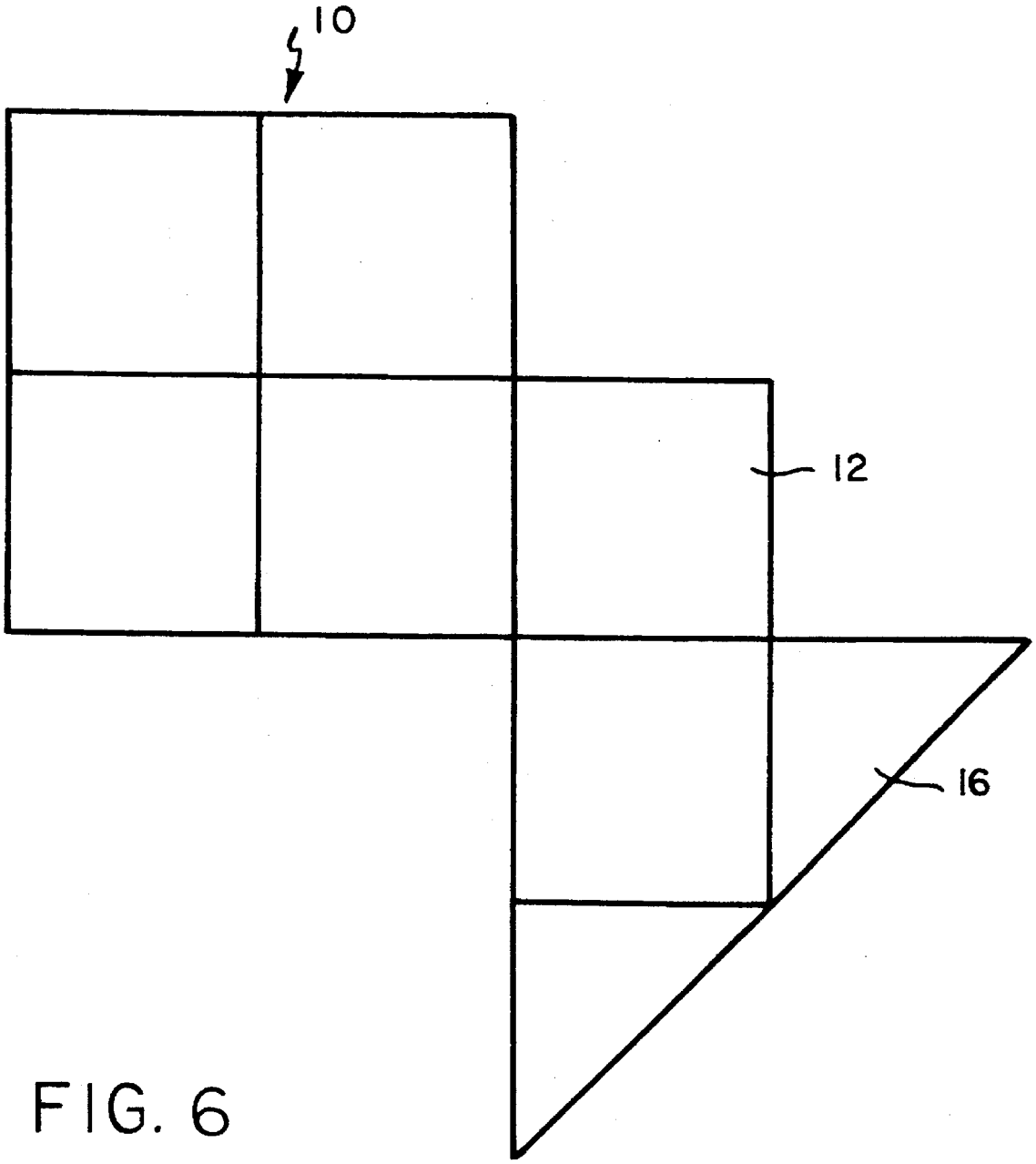
FIG. 6 is a plan view of a building structure having six full modules and two half-modules.

As shown in FIG. 3, any two identical full modules, when joined together, will form a structure which is self-supporting, requiring no tethering or no interior support; thus, providing unrestricted interior space. Such a structure can be extended in any direction to cover any area of ground—by the simple addition of further modules (full and/or half). See, FIG. 6. In this same fashion, the resulting building structure can be shaped to fit any particular building site, or shaped to conform with any particular zoning, setback requirements or building regulations without redesign or alteration of the individual building modules. Similarly, the building structure can be extended (or in fact reduced) in shape at any future time without alteration or redesign of the module structure already in place.

The shape of the modules of the present invention offers more economy of material, i.e., the most spatial area covered for the least bulk of material, than almost any other habitable modular design shape known.

A single module (or 2 half-modules) can serve as a cover structure, a canopy, a roof, if it is adequately tethered and steadied (as for instance by a single post at one of the high corners).

Once the typical modular building structure is erected and positioned as desired, exterior and interior walls (not shown) can be positioned as to produce a habitable living space having unrestricted interior space without interior supports. Since the interior walls are not essential for support, the design and division of interior spaces is unlimited.

The building modules of the present invention may either be fabricated on site, or the modules can be prefabricated in a factory situation, particularly in the smaller sizes, and carried to the building site.

The skilled artisan will recognize that it may be difficult to join one module of elliptical shape to another module of non-identical shape. But, for any given instance, a wide variety of module elliptical shapes are possible, so long as they meet the following criteria: (a) all of them being square in plan, and (b) elliptical in elevation, as previously described. They may vary both in extent and altitude. There may be certain practical limits in their dimensions, but two-, three-story, and higher structures are clearly possibilities that can be achieved using the building modules described herein.

In addition to the illustrated configurations, there is another manner of joining the modules of the present invention which is possible, albeit unusual. That joining is where four modules are joined in a square pattern, in which the low point, e.g., a support point, is located at the center of the four modules. This provides a structure which is most open at its outer edge, which narrows to a central junction point. While not preferred, such a structure can be useful.

It will be understood that changes may be made in the above construction and in the foregoing sequences of operation without departing from the scope of the present invention. It is accordingly intended that all matter contained in the above description or shown in the accompanying drawings be interpreted as illustrative rather than in a limiting sense.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A monolithic building module being substantially square in plan view, wherein two opposite corners of the module are elevated and the other two corners are in ground contact, the module having a portion of an ellipse as seen in cross-section, and wherein said module is capable of being interconnected with an unlimited number of like modules to form a self-supporting modular building structure having substantially unrestricted interior space and forming a level horizontal surface at the apex of the junction of any two modules.

2. A composite building system comprising at least two building modules of claim 1.

3. A monolithic self-supporting modular building structure consisting essentially of, at least two interconnected building modules, said module being substantially square in plan view, wherein two opposite corners of the module are elevated and the other two corners are in ground contact, the module having a portion of an ellipse as seen in cross-section, and wherein said module is capable of being interconnected with an unlimited number of like modules to form a self-supporting modular building structure having substantially unrestricted interior space and forming a level horizontal surface at the apex of the junction of any two modules.

4. The modular building structure of claim 3, wherein four building modules are interconnected.

* * * * *